United States Patent [19]

Schimko et al.

[11] Patent Number: 4,463,578

[45] Date of Patent: Aug. 7, 1984

[54] SINGLE OR MULTIPLE CAM UNIT FOR KNITTING MACHINES

[75] Inventors: Reinhold Schimko, Aalen-Wasseralfingen; Albert Lutz, Westhausen; Gottfried Kühnert, Aalen, all of Fed. Rep. of Germany

[73] Assignee: Universal Maschinenfabrik Dr. Rudolf Schieber GmbH & Co. KG, Westhausen, Fed. Rep. of Germany

[21] Appl. No.: 422,492

[22] Filed: Sep. 23, 1982

[30] Foreign Application Priority Data

Sep. 30, 1981 [DE] Fed. Rep. of Germany ..... 3138986

[51] Int. Cl.[3] ..... D04B 7/00

[52] U.S. Cl. ..... 66/75.1

[58] Field of Search ..... 66/78, 75.1, 75.2, 64, 66/60

[56] References Cited

U.S. PATENT DOCUMENTS 3,615,145 10/1971 Goller et al. ..... 66/78
3,955,381 5/1976 Panchaud ..... 66/75.1
4,287,727 9/1981 Otoshi ..... 66/78
4,294,085 10/1981 Trautner ..... 66/75.1

FOREIGN PATENT DOCUMENTS 2939066 4/1981 Fed. Rep. of Germany ..... 66/75.1

*Primary Examiner*—Ronald Feldbaum
*Attorney, Agent, or Firm*—Sughrue, Mion, Zinn, Macpeak and Seas

[57] ABSTRACT

A single or multiple cam unit for knitting machines, with needle feet of the knitting needles selectively lowerable by means of a needle selector device into the needle channels of the needle beds, comprises fixed and movable cam elements of the cam units (D) and pressure cam elements (17, 18, 19, 20) for each cam unit (D) cooperating with the needle selector device. In order to effect a transfer of stitches independently of the carriage traverse direction and independently of the transfer direction towards the front, towards the rear or in both directions at the same time, each cam unit (D) is constructed symmetrical about the central axis (M) of the cam unit (D), each cam unit (D) includes a cam element (8) oscillatable in the cam plane for extending the needles during knit-stitch formation as well as a controllable cam element (6) for tuck-stitch formation and, in each cam element (D), fixed transfer cam elements (27,28) and fixed acceptor cam elements (24,23) for stitch transfer are provided.

2 Claims, 3 Drawing Figures

SINGLE OR MULTIPLE CAM UNIT FOR KNITTING MACHINES

DESCRIPTION

Figure 1:
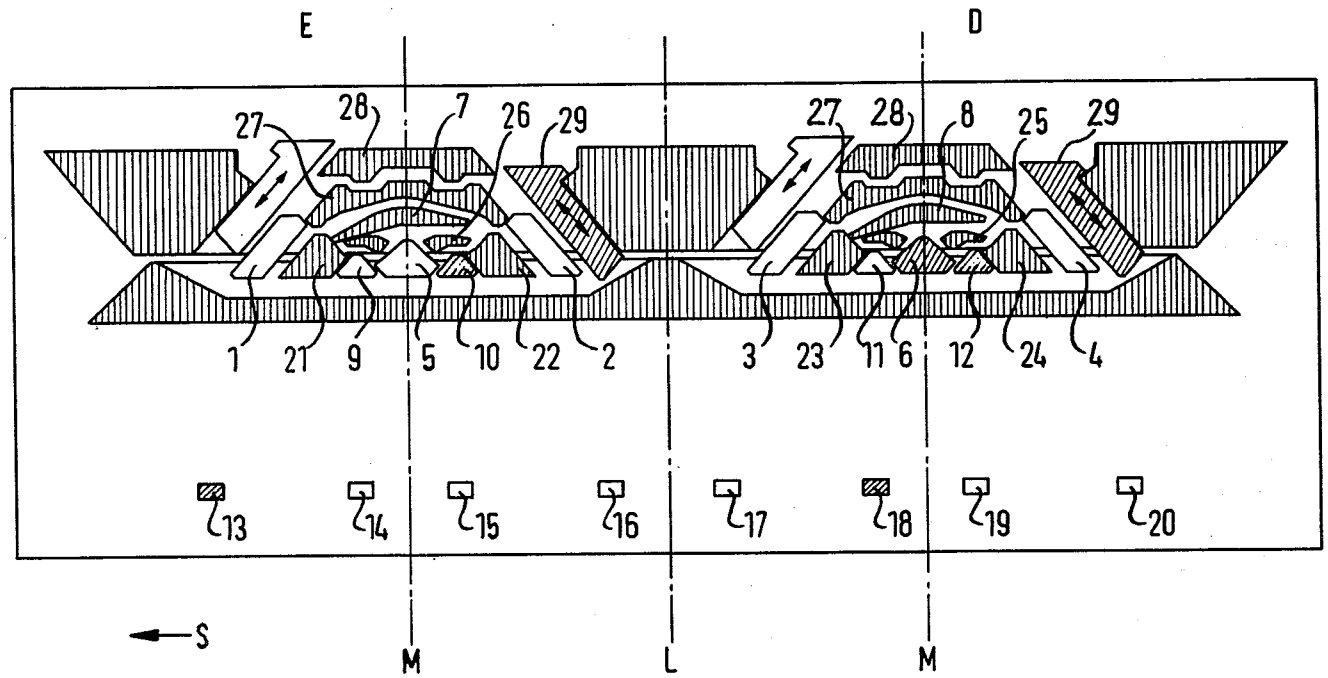

The invention relates to a single or multiple cam unit for knitting machines with needle feet of the knitting needles selectively lowerable by means of a needle selector device into the needle channels of the needle beds, with fixed and movable cam elements of the cam units and with pressure cam elements for each cam unit cooperating with the needle selector device.

Cam members for knitting machines are known, which, arranged side-by-side, are capable of only knitting or transferring. Also, cam elements are known which are arranged under one another and cooperate with double-foot needles. Finally, a combined knit-transfer double cam member is known with which stitches can be transferred only with the leading cam in one direction, e.g. the stitches leading from right to left forwardly and stitches leading from left to right rearwardly.

The invention is based upon the purpose of providing a single or multiple cam unit of the kind described initially with which apart from knitting, any stitches can be transferred without additional transfer cam elements, that is independently of the carriage traverse direction and of the transfer direction from front to rear, from rear to front or simultaneously in both directions.

This purpose is solved in accordance with the invention in that each cam unit is constructed symmetrically to the central axis of the cam unit, that each cam unit has a cam element oscillatable in the cam plane for advancing the needles in knit-stitch formation, as well as a controllable cam element for tuck-stitch formation, and that in each cam unit fixed transfer cam elements and fixed acceptor cam elements are provided for stitch transfer.

With this combined knit-transfer cam member, independently of the carriage traverse direction, all knit-stitch, tuck-stitch and slip-stitch combinations can be made forwardly and rearwardly from transfers and from knit stitches in both carriage traverse directions. Since each cam unit represents a complete and self-contained unit, any number of cam units can be arranged together for increasing productivity.

Preferably, for each camming unit, at least two pressure cam elements are provided per carriage traverse direction.

Advantageously, two cam elements for the transfer of stitches are provided which are actuatable in connection with two pressure cam elements arranged symmetrically to the central axis of the cam unit.

Furthermore, in each cam unit, two cam elements for the acceptance of stitches, which are oscillatable according to the carriage traverse direction in connection with one of two pressure cam elements are preferably provided symmetrically to the central axis of the cam unit.

Advantageously, the selection of needles for knit-stitch formation is effected by one of the two pressure cam elements with the cam elements for the transfer of stitches moved out of actuation.

Finally, in each cam unit, a cam element for tuck-stitch formation is advantageously provided, which is symmetrical to the central axis of the cam unit and is actuatable in conjunction with two pressure cam elements.

Figure 2:
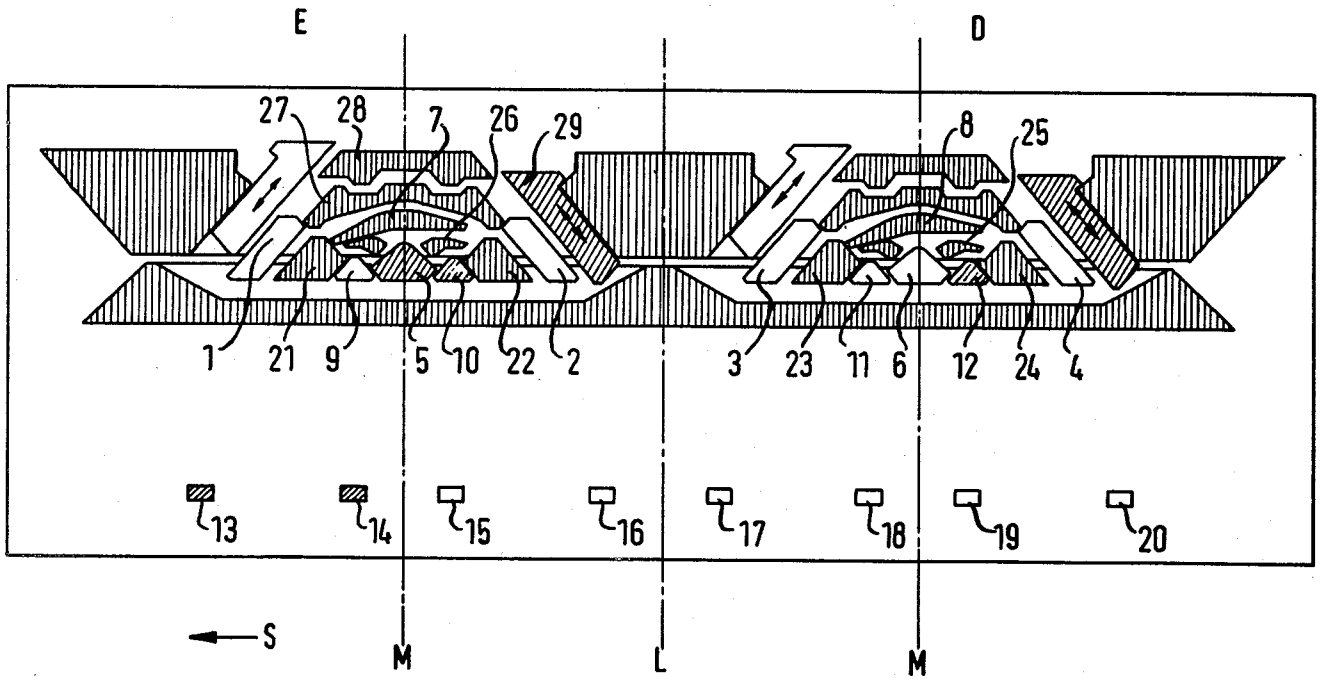
Figure 3:
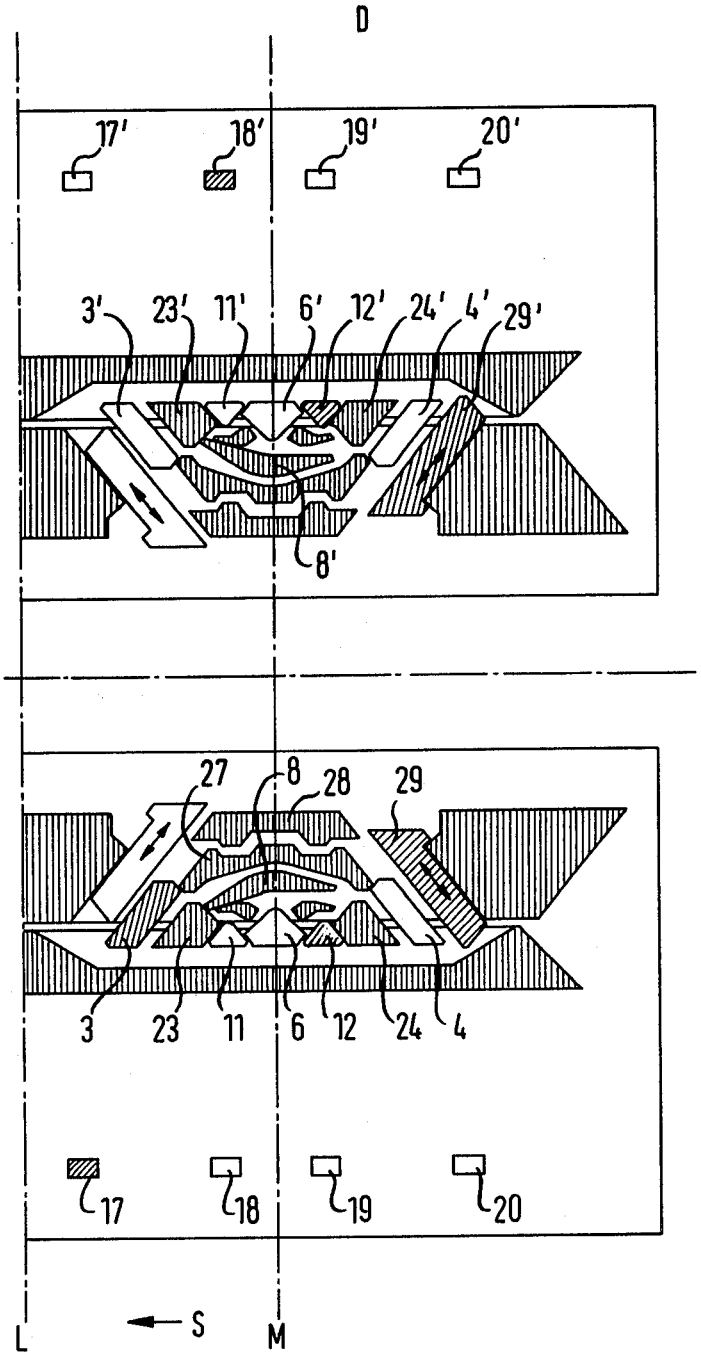

The invention is described in more detail below in conjunction with an embodiment illustrated in the drawings. In the drawings:

FIG. 1 shows two adjacently-arranged cam units according to the invention for a needle bed of a flat knitting machine, where the left cam unit is actuated for knit-stitch formation and the right cam unit for tuck-stitch formation:

FIG. 2 shows two adjacently-arranged cam units as in FIG. 1, where the left cam unit is actuated for simultaneous knit-stitch formation and tuck-stitch formation and the knitting proceeds by the three-path technique by correspondingly omitting selection of the needles which are not knitting; and FIG. 3 shows the right cam unit for both needle beds, where the cam unit for the forward needle bed is arranged for stitch transfer in one carriage traverse in the direction of the arrow and the cam unit for the rear needle bed is arranged for the stitch acceptance.

In FIGS. 1 and 2, a combined knit-transfer cam in a double cam construction is illustrated, which cooperates with a needle selector device, which lowers the needle feet of the knitting needles into the needle channels. The double cam consists of two combined knit-transfer cam units D and E with associated pressure cam elements. All fixed non-actuatable cam elements are cross-hatched vertically. The two cam units D and E are made symmetrical about the central line L and the cam elements 1, 2, 3, 4, 5 and 6 are actuatable out of and into use independently of one another by downward and return movements. The cam elements 9, 10, 11 and 12 are oscillatable elements which are oscillated and switched out of and into actuation position at each carriage reversal.

Cam elements 7 and 8 are constructed symmetrical about the central axis M of each cam unit and are oscillatable from one side to the other in the cam plane such that the leading end of these cam elements 7 and 8 is lowered with respect to the trailing end. Reverse oscillation follows automatically on carriage reversal. Futhermore, pressure cam elements 13, 14, 15, 16, 17, 18, 19 and 20 are provided, which cooperate with the needle selector device (not shown).

In FIGS. 1 to 3 of the drawings, the cam elements and pressure cam elements moved into actuation are illustrated with inclined cross-hatching. In all Figures, the cam element positions and the pressure cam element positions are illustrated during a carriage traverse from right to left in the direction of the arrow S.

In FIG. 1, the position of the cam elements and the pressure cam elements in the leading cam unit E for knitting is illustrated. At the selection station of the pressure cam element 13, the needles for knit-stitch formation are selected. The needle feet at this position project from the needle channels and are engaged by the fixed cam element 21 and are moved out over the cam element 7 into the operative position for knit-stitch formation. The cam elements 1 and 2 are moved out of action, so that the needles can be withdrawn for knit stitch formation from the trailing withdrawal cam element 29, moved downwardly in the direction of the double arrow.

In FIG. 1 furthermore, the position of the cam elements and pressure cam elements in the trailing cam unit D for tuck-stitch formation is shown. At the selection station of the pressure cam element 18, the needles are selected for tuck-stitch formation. The cam element 11 is oscillated out of actuation and the cam element 6 is moved into actuation. The cam element 6 advances the needles into the tuck-stitch position by means of the fixed cam element 25. The cam element 4 is moved out of actuation.

FIG. 2 shows, for the leading cam unit E, the position of the cam elements and pressure cam elements which is necessary in order to make knit-stitches and tuck-stitches in one row. The cam elements 1 and 2 are moved out of operation and the cam element 5 is moved into operation. The cam element 9 is oscillated forwardly out of actuation. At the selection station of the pressure cam element 13, the needles are selected which serve for knit-stitch formation. These needles are advanced by the fixed cam element 21 for knit-stitch formation by means of the cam element 7. By means of the pressure cam element 14, the needles for tuck-stitch formation are selected and are brought into the tuck position by means of the cam element 5 moved into actuation as well as the fixed cam element 27 and are held in this position by the fixed cam element 22.

With the same cam element and pressure cam element position, then knit-stitch formation, tuck-stitch formation and slip-stitch formation take place in one row according to the three-path technique, where the needles which should remain out of actuation are selected at neither of the two selection positions of the pressure cam elements 13 and 14.

FIG. 3 shows the position of the cam elements and pressure cam elements in the trailing cam units D above the front and rear needle beds for the transfer of stitches from front to rear. For the transfer of stitches, the cam element 3 is moved into actuation. At the selection station of the pressure cam element 17, the corresponding needles are selected, which are then engaged by the cam element 3 moved into actuation and are brought into the transfer region, for which the fixed cam elements 27, 28 are effective.

The needles in the rear needle bed accepting the stitches are selected at the selection station of the pressure cam element 18'. The cam element 6' is moved out of actuation and the cam element 12' is moved into actuation. The needles are moved into the transfer position by the cam element 12' oscillated into actuation and the fixed cam element 24'.

The cam elements indicated by ' in the cam unit above the rear needle bed correspond to the cam elements in the cam unit above the front needle bed.

The cam element 23 in the right-hand cam unit D corresponds to the cam element 21 in the left-hand cam unit E and the cam element 22 in the left-hand cam unit E corresponds to the cam element 24 in the right-hand cam unit D.

We claim:

1. In a multiple cam unit for a knitting machine in which the feet of the knitting needles are selectively lowerable in channels of the needle beds by means of a needle selector device, the cam units comprising fixed and movable cam elements and also pressure cam elements which co-operate with the needle selector device, wherein in combination (a) each cam unit is symmetrical about a central axis as known per se and has a first cam element symmetrical with respect to said central axis which is oscillatable in the cam plane for advancing the needles in knit-stitch formation, (b) each cam unit has a second cam element symmetrical with respect to said center axis which is controllable for tuck-stitch formation, (c) fixed transfer cam elements and fixed acceptor cam elements as well as controllable transfer and acceptor cam elements for effecting stitch transfer are provided in each cam unit, and (d) each cam unit has at least two pressure cam elements per needle bed and per carriage traverse direction.

2. A multiple cam unit according to claim 1, wherein needle selection for knit-stitch formation is effected by one of the two pressure cam elements, with the cam elements for stitch transfer held out of actuation.

* * * * *